US006602463B1

(12) United States Patent
Ortner

(10) Patent No.: US 6,602,463 B1
(45) Date of Patent: Aug. 5, 2003

(54) SCENTED ROOM WITH AN AIRFLOW WITH VARYING FRAGRANCES

(76) Inventor: Georg Ortner, Luebecker Strasse 13, D-50668 Koeln (DE)

( * ) Notice: Subject to any disclaimer, the term of this patent is extended or adjusted under 35 U.S.C. 154(b) by 0 days.

(21) Appl. No.: 09/254,986

(22) PCT Filed: Sep. 17, 1997

(86) PCT No.: PCT/EP97/05085

§ 371 (c)(1),
(2), (4) Date: Mar. 17, 1999

(87) PCT Pub. No.: WO98/11970

PCT Pub. Date: Mar. 26, 1998

(30) Foreign Application Priority Data

Sep. 17, 1996 (DE) ..... 196 37 791

(51) Int. Cl.[7] ..... A61L 9/00
(52) U.S. Cl. ..... 422/5; 422/123; 422/124
(58) Field of Search ..... 422/5, 123, 124; 454/241, 243, 244

(56) References Cited

U.S. PATENT DOCUMENTS 4,563,333 A * 1/1986 Frigon ..... 422/122
5,174,967 A * 12/1992 Fukuhara ..... 422/124
5,259,816 A * 11/1993 Ke et al. ..... 422/124
5,760,873 A * 6/1998 Wittek ..... 422/124

FOREIGN PATENT DOCUMENTS

| | | |
|---|---|---|
| CH | 386 660 | 1/1965 |
| DE | 21 30 169 | 12/1971 |
| DE | 2130169 A1 * | 12/1971 |
| DE | 7026058 | 4/1974 |
| DE | 43 14 886 | 5/1993 |

* cited by examiner

*Primary Examiner*—Robert J. Warden, Sr.
*Assistant Examiner*—Sean E. Conley
(74) *Attorney, Agent, or Firm*—Katten Muchin Zavis Rosenman

(57) ABSTRACT

The invention concerns a scented room with several seats for visitors, through which flows an air current with varying fragrances. The fragrance is blown into the scented room from the outside through a flowing channel which is independent from a room air conditioning current feeding a small amount of air. The air quantity fed is passed through at least one processing circuit placed outside the scented room, to which varying fragrance sources can be attached. The scented room is designed as a scent channel through which as air current can flow longitudinally.

18 Claims, 1 Drawing Sheet

SCENTED ROOM WITH AN AIRFLOW WITH VARYING FRAGRANCES

Figure 1:
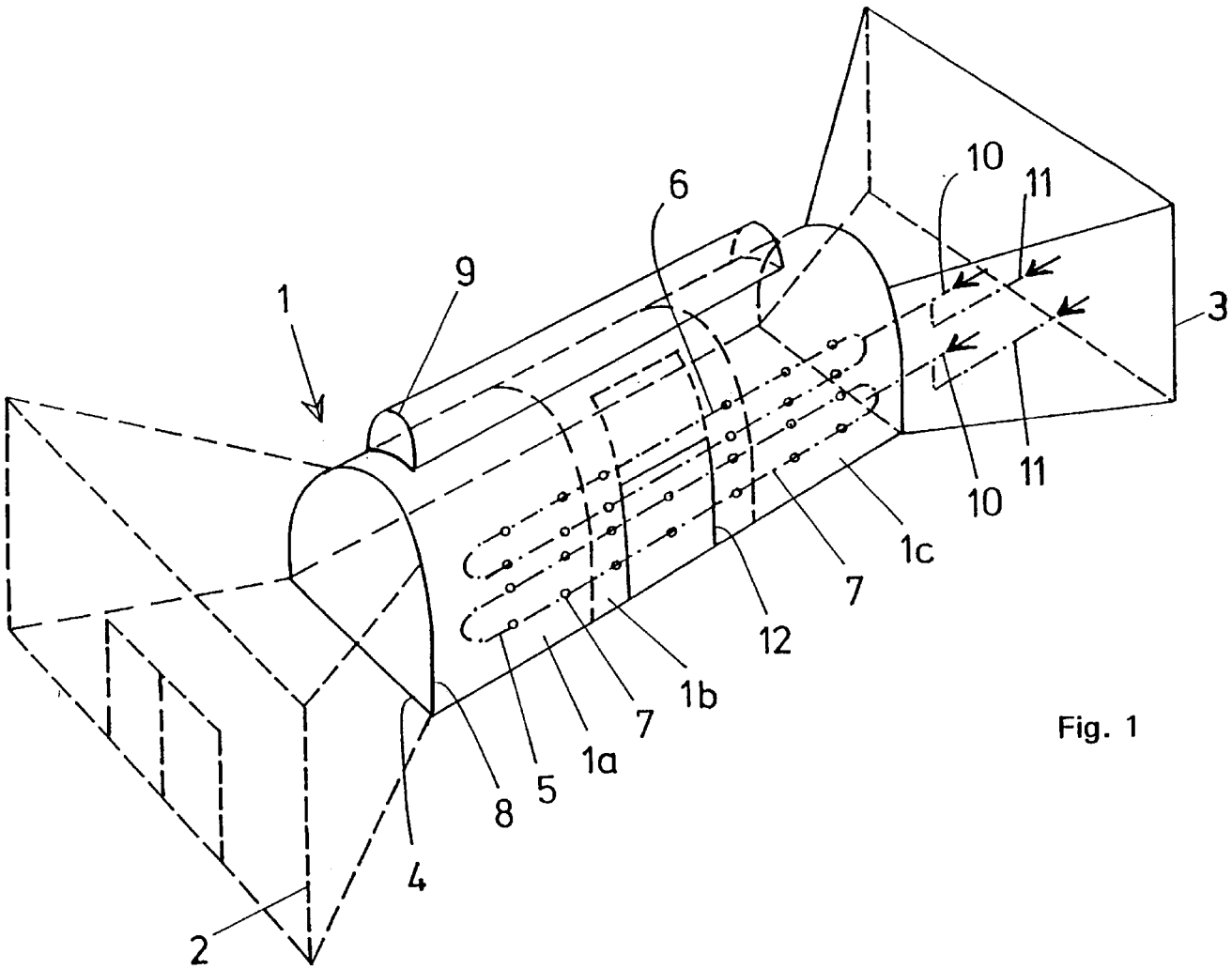

The invention relates to a device according to the preamble of claim 1 and to a method for operation thereof according to claim 16.

In a known method for dispersing a scent in a room (German Patent Application DE A1 2130169), a scent dissolved in solvent is blown in low dosage via a separate supply system into an air-conditioned room and dispersed by the air exchange caused by the air-conditioning system until it again ceases to be perceptible below a corresponding threshold.

According to a comparable known method (Swiss Patent CH 386660), it is provided that one or more scents are supplied to a hall, in which a play is being performed, or to a motion-picture room, where these scents can disperse. For this purpose, the fragrance is atomized inside or outside the room to be scented and supplied to the room to be scented via a line system which contains a blower. Rapid variation of scents is not provided according to this known proposal. Furthermore, uniform dispersion of the fragrance in the room is problematic.

It is further known (German Patent Application A1 4314886) that microscopic quantities of air can be injected via nozzles in the region of seating of motion-picture theaters, playhouses or similar auditoriums. In this way, different scents appropriate to the particular event can be injected in controlled manner into the room air. Either air or helium is suitable as a carrier medium for the fragrance.

In contrast, the object of the present invention is to provide a scented room for rapidly variable scents, which room is designed with simple air-supply technology and which makes it possible to supply these scents to a larger audience at high frequency and in a dosage that is controllable in intensity and duration as simultaneously as possible for all noses.

According to the invention, this object is achieved by the characteristics of claim 1. In the scope of this embodiment, it is provided that a flow of conditioned air is passed through a long scent channel resembling, for example, an aircraft fuselage, preferably comprising a plurality of modular sections, and that an injected air flow can be supplied to this air stream as a partial air stream containing varying fragrances. The supply is achieved expediently via processing circuits uniformly distributed over the length of the scent channel. This is preferably achieved in that the partial air stream is circulated in a line system outside the scent channel, and is in communication with the interior space of the scent channel via injection ports controllable between zero and full flow.

The audience in the scent channel is seated facing in one direction, as in a room for viewing motion pictures. The flow through the scent channel preferably follows the direction in which the audience is looking, or in other words takes place from the rear. The flow velocity of the air-conditioned stream is subject to the normal limit values. Preferably it should be less than 0.5 m/sec.

In synchronism with the scent experiences, the audience is presented with a visual impression in the form of individual pictures or films, the associated projection surfaces preferably being disposed in the ceiling region of the scent channel, so that flow through the space located thereunder can take place substantially without hindrance.

Processing of the fragrance takes place in a separate processing system with proportioning device, by which the fragrance is injected in gaseous form into the respective processing circuit. It is advantageous to provide a plurality of processing circuits, in which the respectively injected fragrance is uniformly dispersed before being supplied to the scent channel. Because the fragrance is thus held in readiness in the respective partial air stream of the processing circuits, it is possible to achieve rapid variation of fragrances.

The fragrance itself can have forms such as liquids, pastes or crystals in the processing system; it is dispersed so finely that it can be blown in molecular form into the processing circuit. Meanwhile, liquid droplets or larger particles are held back by suitable filters. A swirl chamber ensures intimate intermixing of the partial air stream (injection air flow) with the fragrance particles.

Because the scent channel is constructed from individual modular sections, its length can be ideally adapted to the particular circumstances. This is true not only as regards the space conditions at the installation location but also as regards adapting it (in size) to an existing spectator potential.

The scent channel according to the invention exposes people to the largely undiscovered phenomenon of olfaction. It permits the spectator in the scent channel to appreciate the importance of the sense of smell for the purpose of excitement, entertainment or even scientific curiosity. In this context the scent channel is a unique multifunctional and multimedia instrument for exploration of the dimensions of vision, hearing and olfaction (VHO dimension).

Besides its function as an olfactory motion-picture theater, it is suitable for taking over marketing functions such as presentation of new brand-name scents, activation of commercials enhanced by scents, or training of sales personnel for smell-oriented products.

Finally, the scent channel is also suitable as a museum, in that the audience can be acquainted therein with the history of perfumery including the process for extraction of fragrances and the anatomy of olfaction.

In the capacity of a technical institute with scientific leaning, the scent channel can be used to conduct olfaction seminars or for training.

The usefulness of the scent channel for different sectors and target groups is therefore undisputed. Not only can the brand-name perfume industry introduce its innovations therein and if necessary present them three-dimensionally by vision, hearing and olfaction, but also the chemical industry and olfactory industry can use the scent channel for image campaigns or as a clarification instrument. Finally it also offers the food industry interesting options, especially in presentation of cooking classes in the VHO dimension.

The invention will be explained hereinafter with reference to the drawing.

This shows a perspective diagram of the outside view of scent channel 1, whose shell of approximately semicylindrical cross section is composed of a plurality of modular sections 1*a*, 1*b*, 1*c*. At its left end, scent channel 1 is closed off by a publicly accessible lobby 2 for visitors, as indicated by dashed lines. Alternatively, the lobby can also be constructed as a building which completely or partly encloses the scent channel. At its right end, scent channel 1 is closed off by an operations building 3 containing technical equipment. The air-conditioning system and the processing system for the fragrance are installed among other equipment in operations building 3. The air-supply ducts for processing of partial air flows mixed with fragrance are illustrated in the form of a processing circuit 5 laid under floor 4 of scent channel 1 and of a processing circuit 6 integrated in the upper side-wall region; each circuit extends substantially over the entire length of scent channel 1. Each processing circuit 5, 6 is set up for a partial air flow via respective air supplies 10, into which there open line connections 11 for the fragrance.

The fragrance-enriched partial air stream in processing circuits 5, 6 is in communication with the interior of scent channel 1 via a plurality of injection ports 7—several in the region of each modular section 1*a*, 1*b*, 1*c*. Injection ports 7 can be actuated via slides or valves, not shown in more detail, so that the inflow instant and inflow rate are controllable. By the plurality of injection ports 7, it is ensured that a new scent can be smelled simultaneously by all visitors in scent channel 1. For this purpose the scent can flow in via the processing circuits through floor 4 of scent channel 1 or laterally through its semicylindrical shell 8 or simultaneously through injection ports 7 in floor 4 and in lateral shell 8.

Scent channel 1 substantially comprises a semicylindrical shell 8. The visitors enter the scent channel either through lobby 2 or through sliding side doors 12, of which only one is shown as an example in the region of middle modular section 1*b*. Shell 8 of scent channel 1 is provided on its top side with a roof molding 9, which is continuous in longitudinal direction, and in which the projection surfaces for the film presentations or for the display of pictures are mounted. Thereby uniform flow of conditioned air through the scent channel over its entire length is made possible. The conditioned air is processed in operations building 3 and flows through the associated end wall of scent channel 1 thereinto; in the region of the opposite end wall there is exhausted the scented and conditioned room air, which either is blown from there as spent air into the environment or is returned to operations building 3 for reprocessing via air ducts, which are not shown.

Individual modular sections 1*a*, 1*b*, 1*c* are constructed identically to each other and are equipped with corresponding connections or couplings for the lines, both of the electrical and air-conditioning equipment. Thereby it is possible to prefabricate scent channel 1 in the form of individually transportable modular sections 1*a*, 1*b*, 1*c* and to assemble it at the installation location. Depending on the chosen number of modular sections, the scent channel can have various lengths, or in other words can be adapted to local conditions.

The seating in the scent channel must be arranged such that the visitor can occupy a largely reclining position, thus enabling him to look directly at a projection surface disposed above the heads of the visitors and thus achieve undisturbed enjoyment of an audiovisual presentation accompanied by smells. By including the world of scents, such presentations are able to provide a new total experience in the scope of the VHO dimension.

I claim:

1. A scented room comprising:

a plurality of visitor places, an air condition system having a passage for air conditioned flow, said room adapted to accommodate air streams containing varying scents that are supplied to the scented room from outside said scented room via separate flow paths which are independent of said passage for air conditioned flow, said separate flow paths being adapted for a smaller injection air flow, a plurality of mutually independent processing circuits for conveying said air streams containing varying scents, which circuits are disposed outside the scented room and to which varying scent sources are connected, and one or more injection ports distributed in the longitudinal direction of the scented room and controllable between zero and full flow for conveying said air streams containing varying scents from said plurality of mutually independent processing circuits to said scented room independent of said passage for air conditioned flow, wherein the scented room is constructed as a scent channel through which said air stream flows longitudinally.

2. A scented room according to claim 1, wherein the scented room further comprises a plurality of identical modular sections.

3. A scented room according to claim 1, further comprising a plurality of modular sections and a plurality of processing circuits having air-supply ducts that are separated corresponding to the modular sections and are connected via injection ports.

4. A scented room according to claim 1, wherein the scent sources for processing contain fragrance in any desired state of aggregation, said scented room further comprising a proportioning device associated with each scent source, which supplies the fragrance in gaseous form to said at least one processing circuit.

5. A scented room according to claim 4, wherein the proportioning device comprises a swirl chamber for dispersing the fragrance in the injection air flow.

6. A scented room according to claim 4, wherein the proportioning device comprises filter means for collection of liquid droplets from fragrance in the injection air flow.

7. A scented room according to claim 1, wherein the scented room has a floor region and a side-wall region and wherein the injection ports are disposed in the floor region and/or in the side-wall regions.

8. A scented room according to claim 1, wherein said room has a substantially semicylindrical cross section, which is mountable with a plane floor surface on an installation surface.

9. A scented room according to claim 1, further comprising opposite end sides that are connected to utility rooms, one room of which substantially houses technical equipment for operation of the scented room.

10. A scented room according to claim 1, further comprising a roof equipped with a continuous bulge or with individual bulges, in which bulge or bulges there are mounted projection surfaces for presentation of films.

11. A scented room according to claim 1, wherein the air stream flow passes from the rear side of the room.

12. A scented room according to claim 1, further comprising:

air-supply ducts provided for said mutually independent processing circuits, a slide for emptying the air-supply duct of at least one processing circuit in which fragrance is mixed, which slide isolates the duct cross section at one position, and a blower allocated to the slide for expelling the contents of the air-supply duct, which blower displaces the air volume of the isolated air-supply duct via the injection ports into the interior of the scented room.

13. A method for operation of a scented room according to claim 1, comprising:

passing of a substantially continuous flow of conditioned room air through the scented room and, processing of different fragrances through the use of said mutually independent processing circuits whose injection air flows are mixed alternately into the room air of the scented room.

14. A method according to claim 13, wherein the injection air flows are mixed in at points distributed over the entire length of the scented room.

15. A method according to claim 14, wherein mixing-in takes place in the longitudinal direction of the scented room in a distribution corresponding to rows of seats for visitors.

16. A method according to claim 13, wherein, before the fragrances are mixed into a processing circuit, they are converted to the gaseous state in a proportioning device through which the injection air flow passes.

17. A method according to claim 16, wherein the injection air flow provided with fresh fragrance is passed successively through a swirl chamber and filter means in a proportioning device.

18. A scented room comprising:

a plurality of visitor places, an air condition system having a passage for air conditioned flow, said room adapted to accommodate air streams containing varying scents that are supplied to the scented room from outside said scented room via separate flow paths which are independent of said passage for air conditioned flow, said separate flow paths further comprising a first flow path for a smaller injection air flow and a second flow path for the introduction of scents to said first flow path, a plurality of mutually independent processing circuits for conveying said air streams containing varying scents, which circuits are disposed outside the scented room and to which varying scent sources are connected, and one or more injection ports distributed in the longitudinal direction of the scented room and controllable between zero and full flow for conveying said air streams containing varying scents from said plurality of mutually independent processing circuits to said scented room independent of said passage for air conditioned flow, wherein the scented room is constructed as a scent channel through which said air stream flows longitudinally.

* * * * *